US006691578B1

(12) United States Patent
Puskas

(10) Patent No.: US 6,691,578 B1
(45) Date of Patent: Feb. 17, 2004

(54) MEASUREMENT SYSTEMS FOR ULTRASOUND IN A VESSEL

(76) Inventor: William L. Puskas, P.O. Box 1676, New London, NH (US) 03257-1676

( * ) Notice: Subject to any disclaimer, the term of this patent is extended or adjusted under 35 U.S.C. 154(b) by 0 days.

(21) Appl. No.: 10/376,096

(22) Filed: Feb. 28, 2003

(51) Int. Cl.[7] ..... B08B 3/12

(52) U.S. Cl. ..... 73/648; 134/57 R; 134/113; 134/184; 134/902

(58) Field of Search ..... 73/645, 646, 647, 73/648, 570, 432.1, DIG. 1; 134/1, 1.3, 18, 57 R, 57 D, 113, 184, 186, 902

(56) References Cited

U.S. PATENT DOCUMENTS 4,704,902 A * 11/1987 Doshi ..... 73/149
4,710,233 A * 12/1987 Hohmann et al. ..... 205/701
4,996,403 A * 2/1991 White ..... 219/706
5,834,871 A * 11/1998 Puskas ..... 310/316.02
5,931,173 A 8/1999 Schiele ..... 134/57
6,288,476 B1 9/2001 Puskas ..... 310/325
6,450,184 B1 9/2002 Azar ..... 134/57
6,557,564 B1 * 5/2003 Birang ..... 134/1.3

* cited by examiner

*Primary Examiner*—Hezron Williams
*Assistant Examiner*—Rose M. Miller
(74) *Attorney, Agent, or Firm*—The Bilicki Law Firm P.C.

(57) ABSTRACT

The invention produces a change to the acoustic input power applied to a liquid in a vessel. The magnitude and shape of the resulting change in the ultrasonic field in the vessel is measured and this data is used to determine the ultrasonic activity in the vessel. This measured ultrasonic activity is displayed as a measure of the performance of the system and/or it is fed back to the ultrasonic transmitter to control or maintain the process.

29 Claims, 4 Drawing Sheets

MEASUREMENT SYSTEMS FOR ULTRASOUND IN A VESSEL

FIELD OF THE INVENTION

The embodiments of the invention discussed herein relate to systems and methods for measuring and controlling ultrasound in a vessel.

BACKGROUND OF THE INVENTION

The present invention relates to ultrasonic cleaning and ultrasonic processing systems, and more particularly, to systems, probes, ultrasonic generators (referred to herein as ultrasonic transmitters to distinguish them from ultrasonic receivers), ultrasonic transducers, circuitry and methods that clean and/or process by coupling ultrasonic waves into a liquid. Prior art ultrasonic systems lack the ability to measure and control the ultrasound in a vessel to a predetermined value of ultrasonic activity, which is related to the total acoustic energy in the vessel. This invention improves the performance of an ultrasonic system by introducing consistency of process either through measurement of the process and/or control of the process based on the measured ultrasonic activity.

The prior art describes probes that measure ultrasonic waves, cavitation intensity and other ultrasonic characteristics at a certain location in an ultrasonic vessel. This is most useful for ultrasonic vessels with uniform ultrasonic fields because the point measurement can be used as a measure of the ultrasonic characteristics in the rest of the vessel, however, in a practical situation where the vessel is loaded with parts to be cleaned, the ultrasonic field is seldom uniform.

Examples of prior art probes are shown in U.S. Pat. Nos. 5,931,173; 6,288,476 B1 and 6,450,184 B1. Each of these probes measure the ultrasonic characteristics at the place in the vessel where the probe is located. Because of the non uniform ultrasonic field in a practical ultrasonic vessel containing parts to be cleaned or processed, this point measurement often does not give accurate information about the over all ultrasonic field in the vessel.

Therefore, there is a need in the field of ultrasonic processing and ultrasonic measurement to measure a characteristic that is representative of the total ultrasonic activity within a vessel and use this measurement to control the process.

SUMMARY OF THE INVENTION

The embodiments of the present invention relate to the applied uses of ultrasonic energy, and in particular the application and control of ultrasonic energy to clean and process parts within a liquid. Generally, an ultrasonic transmitter drives one or more ultrasonic transducers, or arrays of transducers, coupled to a liquid to clean and/or process a part. In the embodiments disclosed herein, the liquid is held within a vessel; and the transducers mount on or within the vessel to impart ultrasound into the liquid.

When the transmitted signal from the ultrasonic transmitters undergoes a power change (for example, is changed from supplying power to an OFF condition), measurement of the ultrasonic initial amplitude and decay time in the vessel is then received and monitored by the transducers. The ultrasonic initial amplitude and decay time is a measure that can be related to the ultrasonic activity in the vessel prior to the power change. The resulting signal is sent to the ultrasonic receiver, which can record the magnitude and shape of the changes in the ultrasonic signal over time following the power change. A function of the initial amplitude and decay time can then be displayed to show the ultrasonic activity of the system. In this way, measurement of ultrasonic activity in a vessel can be made at any time, or at various intervals, by inserting a power change. Information regarding the ultrasonic activity in the vessel can be displayed for use by an operator of the equipment or fed back to the transmitter for automatic adjustment of the process.

The preceding embodiments of the invention disclose using the same transducer(s) for producing and transmitting an ultrasonic signal, as well as for receiving and measuring the ultrasonic signal over time after the power change. Another embodiment of the invention uses an additional transducer, which can either be a probe or a different transducer used as a probe, to receive the ultrasonic characteristics during and/or after a power change from the transmitting transducers. The typical probe would be made by mounting piezoelectric ceramic in a housing, as is common in the art. The unique feature of this probe, or separate transducer functioning as a probe, is that it works in conjunction with the transmitting transducers and measures the magnitude and shape of the ultrasonic changes over time during and/or after a power change in the transmitted ultrasonic signal.

In still another embodiment of the invention, the steady state magnitude of the ultrasonic signal measured by the probe, or separate transducer functioning as a probe, is recorded as a function of frequency (for example, by a spectrum analyzer). This provides information regarding the magnitude of the ultrasonic signal, as well as frequency components that are useful in determining the size of cavitation implosions within the liquid-containing vessel.

Moreover, one of ordinary skill in the art will readily appreciate that a common way to introduce an ultrasonic signal into a liquid-containing vessel is by use of an "immersible." An immersible, as used herein, is defined as a sealed container that holds one or more transducers and that is immersed in the vessel. The teachings of this invention are applicable to both vessel-mounted transducers and immersible mounted transducers and an immersible that forms a self-contained measuring system.

BRIEF DESCRIPTION OF THE DRAWINGS

A more complete understanding of the invention may be obtained by reference to the drawings, in which.

DESCRIPTION OF THE PREFERRED EMBODIMENTS

Figure 1:
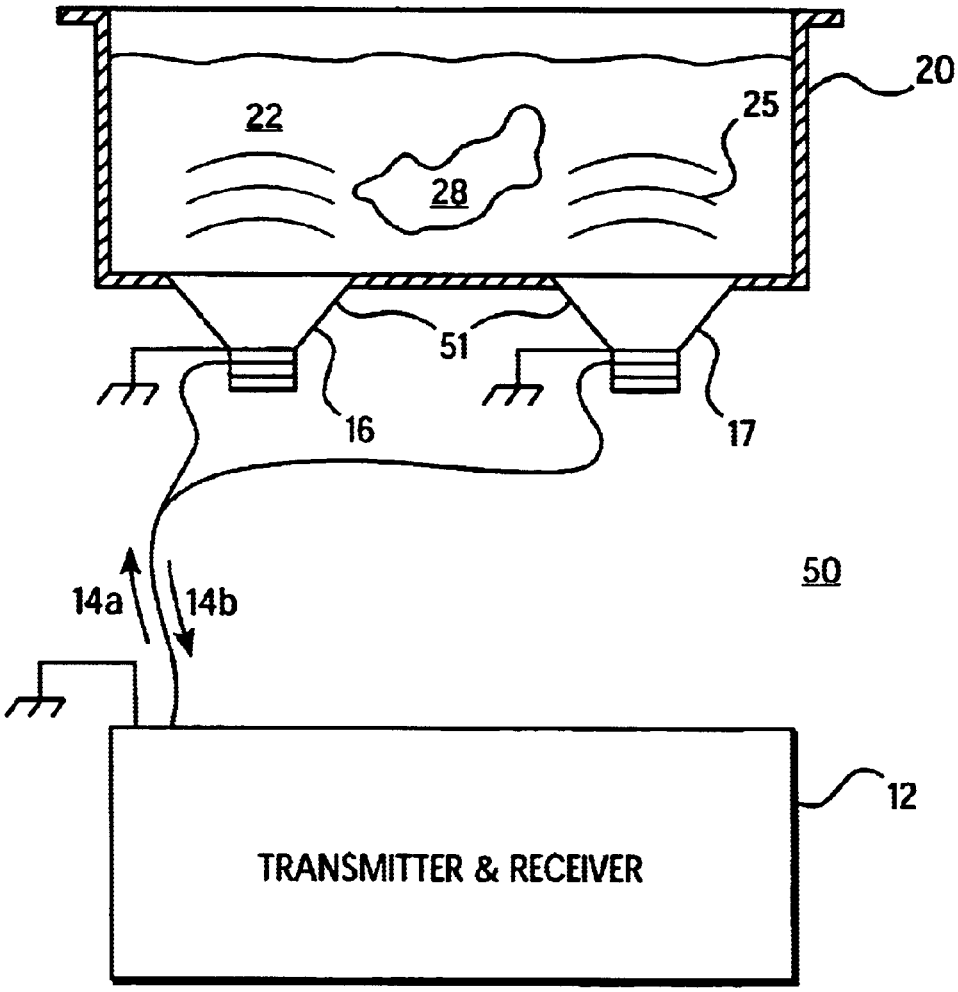
FIG. 1 shows a cross-section of an ultrasonic processing system where the same transducer array is used for both transmitting and receiving.

For the purpose of promoting an understanding of the present invention, reference is made to embodiments of the invention as illustrated in the drawings. It is nevertheless understood that no limitations of the scope of the invention is thereby intended. For example, alterations in the type of transducer, probe or ultrasonic cleaning vessel could provide additional embodiments, which would fall within the spirit and scope of the invention, described herein. For the ease of the reader, like reference numerals designating identical or similar parts remain consistent through the drawings.

Moreover, the terms "substantially" and "approximately" as used herein may be applied to modify any quantitative representation that could permissibly vary without resulting in a change in the basic function to which it is related. For example, an ultrasonic signal as disclosed herein having an ultrasonic frequency of above approximately 18 kHz may permissibly have an ultrasonic frequency of above 17.9 kHz within the scope of the invention if its capability of cleaning and/or processing a designated part is not materially altered. Although the definition of ultrasound is any frequency above the range of human hearing, the typical range for ultrasound in liquid is about 18 kHz to 4 MHz.

FIG. 1 shows a cross-section schematic of one embodiment of the invention, ultrasonic processing system 50. Ultrasonic processing system 50 comprises ultrasonic transmitter and receiver 12 and transducer array 51 for both transmitting and receiving an ultrasonic signal. In the embodiment shown in FIG. 1, transducer array 51 comprises ultrasonic transducers 16 and 17. Ultrasonic transmitter and receiver 12, when used to transmit an ultrasonic signal, electrically connects, via electrical path 14*a,* to ultrasonic transducers 16 and 17 to drive transducers 16 and 17 at specified power levels at a frequency or a bandwidth of frequencies in the range of approximately 18 kHz to approximately 4 MHz. Typically, transducers 16 and 17 are made from ceramic, piezoelectric, or magnetostrictive materials that expand and contract with applied voltages or current to create ultrasound. In the embodiment shown here, ultrasonic transducers 16 and 17 are mounted to the bottom of ultrasonic treatment vessel 20. However, one of ordinary skill in the art will readily appreciate that ultrasonic transducers 16 and 17 can be mounted to the sides, or within ultrasonic treatment vessel 20.

Liquid 22 fills vessel 20 to a level sufficient to cover part 28, the part to be processed and/or cleaned. In operation, transmitter and receiver 12 first transmits an ultrasonic signal to transducers 16 and 17 to create acoustic energy 25 that couples into liquid 22. Next, when the transmitted power is reduced to zero, transmitter and receiver 12 receives a signal from transducers 16 and 17 via electrical path 14*b*. In this case, where transducers 16 and 17 are used to both transmit and receive the ultrasonic signal, electrical paths 14*a* and 14*b* are the same path. A function of the initial amplitude and decay time of the received signal during and after the change in transmitted power is used as the measure of ultrasonic activity in vessel 20.

Figure 2:
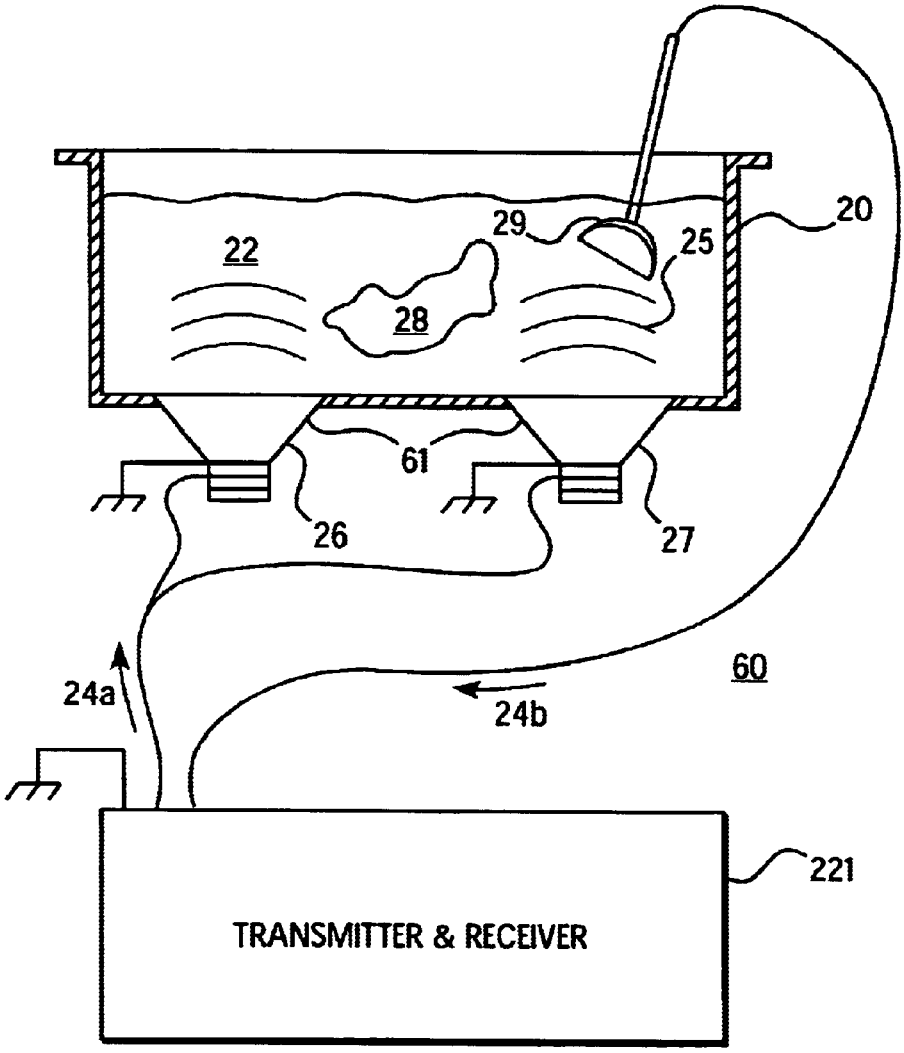
FIG. 2 shows a cross-section of an ultrasonic processing system where a probe is used for receiving.

FIG. 2 shows a cross-section schematic of another embodiment of the invention, ultrasonic processing system 60. Ultrasonic processing system 60 comprises ultrasonic transmitter and receiver 221, transducer array 61 for transmitting an ultrasonic signal, and probe 29 for receiving an ultrasonic signal. In the embodiment shown in FIG. 2, transducer array 61 comprises ultrasonic transducers 26 and 27. Ultrasonic transmitter and receiver 221, when used to transmit an ultrasonic signal, electrically connects, via electrical path 24*a,* to ultrasonic transducers 26 and 27 to drive transducers 26 and 27 at specified power levels at a frequency or a bandwidth of frequencies in the range of approximately 18 kHz to approximately 4 MHz.

Liquid 22 fills ultrasonic treatment vessel 20 to a level sufficient to cover part 28 to be processed and/or cleaned. In operation, transmitter and receiver 221 first transmits a signal to transducers 26 and 27 to create acoustic energy 25 that couples into liquid 22. Next, transmitter and receiver 221 receives a signal from probe 29 via path 24*b* when the transmitted power is reduced to zero or changed. The magnitude and shape, e.g., the initial amplitude and decay time or the build up time, of the received signal is used to measure the ultrasonic activity within the vessel.

In addition, one of ordinary skill in the art will readily appreciate that it is possible to monitor the ultrasonic characteristics at the location of probe 29 during the steady state power delivery to vessel 20 and use this data in addition to the new data obtained by measuring the magnitude and shape of the acoustic curve that results from a power change to the vessel. In this way, the conventional measurement can be used for continuous monitoring and, when a change is captured, the power change measurement technique can be employed to analyze the condition of the acoustic field in vessel 20 and make appropriate corrections based on this ultrasonic activity measurement. Moreover, continuous monitoring of the steady state signal can indicate the power change direction that is best for the power change phase. For example, if continuous monitoring showed a decrease in the steady state ultrasonic measurement at the position of probe 29, it would be advisable to introduce a step increase in transmitted power to keep the process as close to constant as possible while making the power change measurement.

Figure 3:
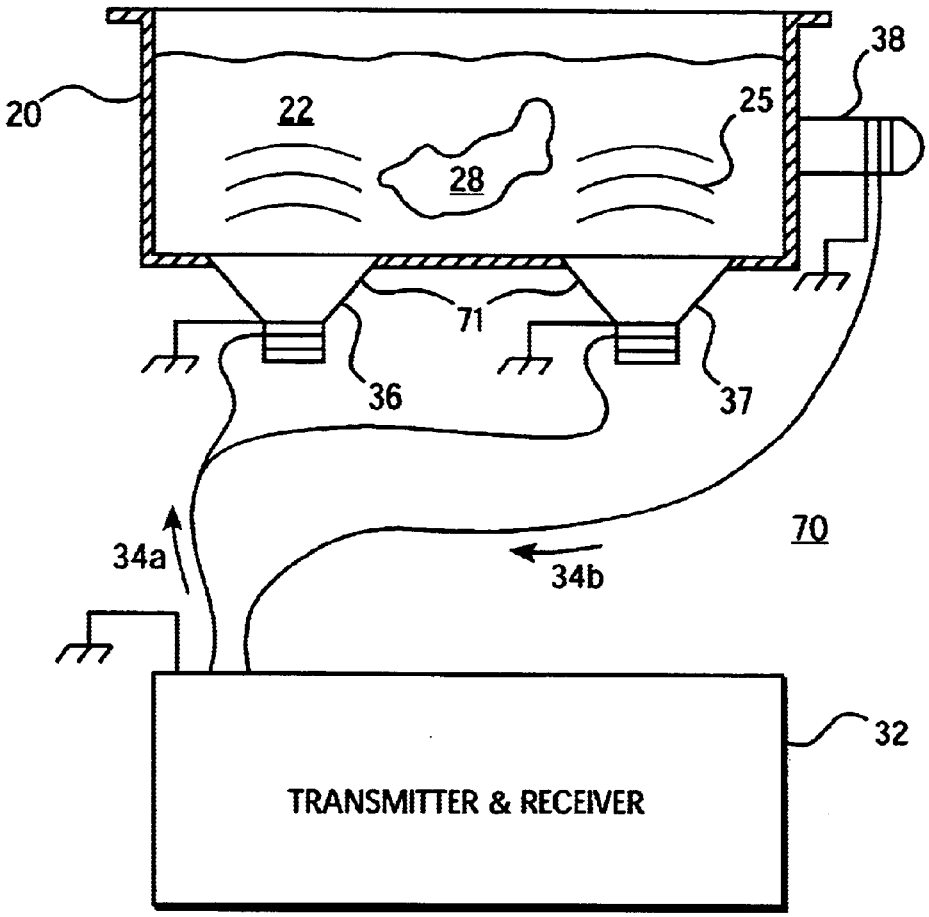
FIG. 3 shows a cross section of an ultrasonic processing system where a different transducer is used for receiving.

FIG. 3 shows a cross-section schematic of still another embodiment of the invention, ultrasonic processing system 70. Ultrasonic processing system 70 comprises ultrasonic transmitter and receiver 32, transducer array 71 for transmitting an ultrasonic signal, and transducer 38 for receiving an ultrasonic signal. In the embodiment shown in FIG. 3, transducer array 71 comprises ultrasonic transducers 36 and 37. Ultrasonic transmitter and receiver 32, when used to transmit an ultrasonic signal, electrically connects, via electrical path 34*a,* to ultrasonic transducers 36 and 37 to drive transducers 36 and 37 at ultrasonic frequencies above approximately 18 kHz.

Liquid 22 fills ultrasonic treatment vessel 20 to a level sufficient to cover part 28 to be processed and/or cleaned. In operation, transmitter and receiver 32 first transmits a signal to transducers 36 and 37 to create acoustic energy 25 that couples into liquid 22. Next, transmitter and receiver 32 receives a signal from transducer 38 via electrical path 34*b* when the transmitted power is reduced to zero or changed. The magnitude and shape of the received signal is used to measure the ultrasonic activity within the vessel. Similar to probe 29 in FIG. 2, transducer 38 in FIG. 3 can also monitor the continuous ultrasonic field during normal operation and use this data in addition to the data taken during the power change phase. The two types of data can be used as described above for probe 29 of FIG. 2.

Transducer 38 can be a unique transducer, a single piezoelectric ceramic or a transducer similar to transducers 36 and 37.

The measured parameter from the probe of FIG. 2 or from the transducer of FIG. 3 will normally be its output voltage or output current; however, other parameters such as output power can be measured. One of ordinary skill in the art will readily appreciate that the direction of power change from the transmitted signal can be either an increase in power or a decrease in power. For the case of an increase in power, the received signal is the initial amplitude and the build up rate of the voltage or current; and for the case of a decrease in power, the received signal is the initial amplitude and the decay rate of the voltage or current.

Figure 4:
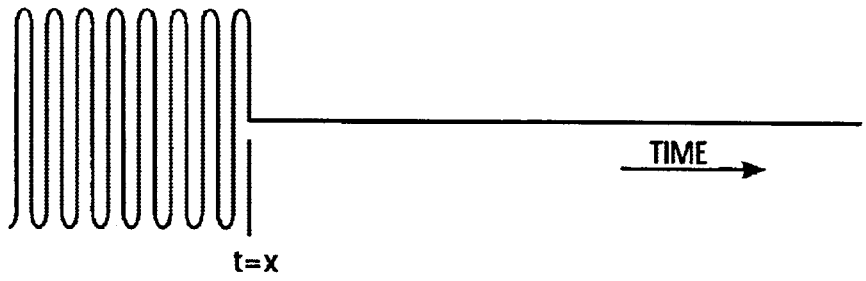
FIG. 4 shows a transmitting waveform with a change in power level to zero.
Figure 5:
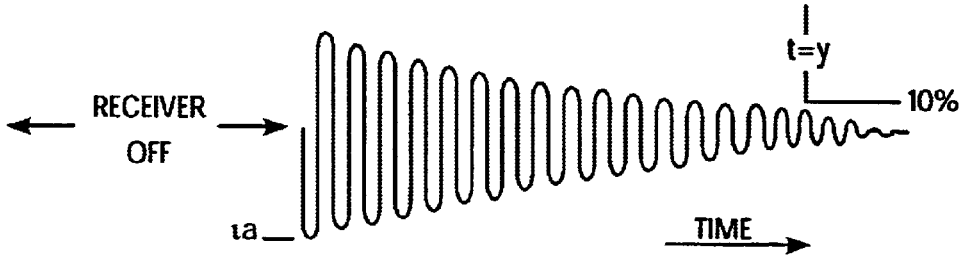
FIG. 5 shows a received waveform in a lightly loaded vessel on the same time scale as FIG. 4.
Figure 6:
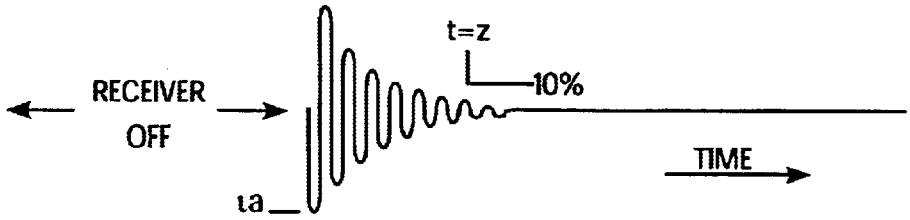
FIG. 6 shows a received waveform in a heavily loaded vessel on the same time scale as FIG. 4.

FIG. 4 shows a transmitting waveform with a change in power level to zero at time t=x. In this figure, current is shown on the y-axis. However, voltage is also a useable measure with a similar form. FIG. 5 shows a received waveform in a lightly loaded vessel on the same time scale as FIG. 4. In FIG. 5, the received signal starts at time t=x and is shown to decay to 10% of its initial amplitude at time t=y. The time t=y-x in combination with the initial amplitude, ia, is a measure related to the ultrasonic activity in the vessel. FIG. 6 shows a received waveform in a heavily loaded vessel on the same time scale as FIG. 4. In FIG. 6, the received signal starts at time t=x and is shown to decay to 10% of its initial amplitude at time t=z. The time t=z-x in combination with the initial amplitude, ia, is a measure related to the ultrasonic activity in the vessel. Since y-x is greater than z-x, there is more ultrasonic activity in the vessel with the light load of FIG. 5 compared to the heavy load of FIG. 6.

Each of the figures used herein as an example show the transmitted power going from some finite level to zero. One of ordinary skill in the art will readily appreciate that any change in transmitted power can be received and the magnitude and shape of the decay or buildup curve can be interpreted to give a measure of ultrasonic activity in the vessel. For example, the transmitted power can be at 90% and then increased to 100%. The received signal will have a magnitude and increase at a rate dependent on the ultrasonic activity in the vessel.

Each embodiment of the invention results in a measurement related to ultrasonic activity. A function of this measurement is typically displayed and fed back to the transmitter to maintain or control the transmitted power. Either of these functions (display or feedback) can be included without the other in a particular embodiment.

In another embodiment of the invention, the cleaning or processing system operates in a normal way, except that it is equipped with a receiver and a switch that allows the user to activate the measurement of ultrasonic activity at will. When the switch is activated, the system chooses an appropriate time, for example, at the end of an ultrasonic burst, and then the power is kept off for a sufficient amount of time, typically between 10 and 80 milliseconds, for the ultrasonic receiver to measure the initial amplitude and decay time of the ultrasonic field within the vessel. A properly conditioned result would typically be displayed for the user to read or record. This form of the invention is useful for a process where the automatic periodic insertion of an off time of sufficient length to measure and continuously display the ultrasonic activity is unacceptable.

It should be noted that the functional relationship between the measured signals and the parameter related to the ultrasonic activity in the liquid in the vessel is not rigorously defined in the art. In general, this relationship can be sized to meet the needs of a useable output display or a reasonable feedback value for the transmitter. A specific example of the functional relationship for one useable parameter that correlates well with ultrasonic activity is "initial amplitude times decay time". This is because ultrasonic activity is related to the total acoustic energy in the vessel, and "energy equals power times time". The initial amplitude relates to the power in the energy formula and the decay time relates to the time in the energy formula, therefore, their product relates to the total acoustic energy in the vessel, which is one measure of ultrasonic activity in the liquid in the vessel.

The invention thus attains the objects set forth above, among those apparent in the preceding description. Since certain changes may be made in the above description without departing from the scope of the invention, it is intended that all matter contained in the above description or shown in the accompanying drawings be interpreted as illustrative and not in a limiting sense. It is also to be understood that the following claims are to cover all generic and specific features of the invention described herein, and all statements of the scope of the invention, which might be said.

What is claimed is:

1. A system for measuring ultrasonic activity within a liquid contained in a vessel, comprising:

at least one transducer adapted for transmitting ultrasound to a liquid and for receiving ultrasound from the liquid;

an ultrasonic transmitter adapted for producing a first signal to drive said at least one transducer at specified power levels at a frequency or a bandwidth of frequencies in the range of approximately 18 kHz to approximately 4 MHz;

an ultrasonic receiver adapted for measuring a second signal from said at least one transducer;

wherein a power change from a positive power level to zero power level is supplied to said at least one transducer by the ultrasonic transmitter; and, wherein the initial amplitude and decay time of said second signal from said at least one transducer is measured by said ultrasonic receiver subsequent to said power change; and, wherein said measured initial amplitude and decay time is converted into a parameter related to the ultrasonic activity prior to said power change.

2. A system according to claim 1 wherein said parameter related to the ultrasonic activity prior to said power change is used to control the positive power level setting of the transmitter.

3. A system according to claim 1 wherein said at least one transducer is contained in an immersible which is placed inside the vessel.

4. A system according to claim 3 wherein said at least one transducer within said immersible forms a self-contained measuring system.

5. A system for measuring ultrasonic activity within a liquid contained in a vessel, comprising:

at least one transmitting transducer adapted for transmitting ultrasound to a liquid;

at least one receiving transducer adapted for receiving ultrasound from the liquid;

an ultrasonic transmitter adapted for producing a first signal for driving said at least one transmitting transducer at specified power levels at a frequency or a bandwidth of frequencies in the range of approximately 18 kHz to approximately 4 MHz;

an ultrasonic receiver adapted for measuring a second signal from said at least one receiving transducer;

wherein a power change is supplied to said at least one transmitting transducer by said ultrasonic transmitter;

the magnitude and shape of said second signal from said at least one receiving transducer is measured by said ultrasonic receiver; and, the magnitude and shape of said second signal from said at least one receiving transducer is converted into a parameter related to the ultrasonic activity in the liquid contained in the vessel.

6. A system according to claim 5 wherein said parameter related to the ultrasonic activity is used to control the power level of said ultrasonic transmitter.

7. A system according to claim 5 wherein said power change is from one of the specified power levels to zero power.

8. A system according to claim 5 wherein said power change is from a lower power level to a higher power level and said second signal is the initial amplitude and build up rate of the voltage of said at least one receiving transducer.

9. A system according to claim 5 wherein the power change is from a higher power level to a lower power level and said second signal is the initial amplitude and decay time of the voltage of said at least one receiving transducer.

10. A system according to claim 5 wherein the power change is from a lower power level to a higher power level and said second signal is the initial amplitude and build up rate of the current of said at least one receiving transducer.

11. A system according to claim 5 wherein the power change is from a higher power level to a lower power level and said second signal is the initial amplitude and decay time of the current of said at least one receiving transducer.

12. A system according to claim 5 wherein said at least one transmitting transducer and said at least one receiving transducer are contained in an immersible which is placed inside the vessel.

13. A system according to claim 12 wherein said at least one transmitting transducer and said at least one receiving transducer within said immersible form a self-contained measuring system.

14. A system for measuring ultrasonic activity, comprising:

at least one transmitting transducer adapted for transmitting a first ultrasonic signal to a liquid contained in a vessel;

a probe for receiving a second ultrasonic signal from the liquid;

an ultrasonic transmitter adapted for producing said first signal for driving said at least one transmitting transducer at specified power levels at a frequency or a bandwidth of frequencies in the range of approximately 18 kHz to approximately 4 MHz;

an ultrasonic receiver adapted for measuring said second signal from said probe;

wherein a power change is supplied to said at least one transmitting transducer by said ultrasonic transmitter;

the magnitude and shape of said second signal from said probe is measured by said ultrasonic receiver; and, the magnitude and shape of said second signal from said probe is converted into a parameter related to the ultrasonic activity in the liquid contained in the vessel.

15. A system according to claim 14 wherein said parameter related to said ultrasonic activity is used to control the power level of said ultrasonic transmitter.

16. A system according to claim 14 wherein said power change is from one of the specified power levels to zero power.

17. A system according to claim 14 wherein said power change is from a lower power level to a higher power level and said second signal is the initial amplitude and build up rate of the probe voltage.

18. A system according to claim 14 wherein said power change is from a higher power level to a lower power level and said second signal is the initial amplitude and decay time of the probe voltage.

19. A system according to claim 14 wherein said power change is from a lower power level to a higher power level and said second signal is the initial amplitude and build up rate of the probe current.

20. A system according to claim 14 wherein said power change is from a higher power level to a lower power level and said second signal is the initial amplitude and decay time of the probe current.

21. A system according to claim 14 wherein said at least one transmitting is contained in an immersible which is placed inside the vessel.

22. A system for measuring ultrasonic activity, comprising:

at least one transmitting transducer adapted for transmitting ultrasound to a liquid contained in a vessel;

at least one receiving transducer adapted for receiving ultrasound from the liquid;

an ultrasonic transmitter adapted for producing a first signal for driving said at least one transmitting transducer at specified power levels at a frequency or a bandwidth of frequencies in the range of approximately 18 kHz to approximately 4 MHz;

an ultrasonic receiver adapted for measuring a second signal from said at least one receiving transducer;

wherein a power change is supplied to said at least one transmitting transducer by said ultrasonic transmitter;

a steady state magnitude of said second signal from said at least one receiving transducer prior to the power change and the shape of said second signal from said at least one receiving transducer after the power change are measured by said ultrasonic receiver; and, the magnitude and shape of said second signal are converted into a parameter related to an ultrasonic activity in the liquid contained in the vessel.

23. A system according to claim 22 wherein said parameter related to said ultrasonic activity is used to control the power level of said transmitter.

24. A system according to claim 22 wherein said power change is from one of the specified power levels to zero power.

25. A system according to claim 24 wherein said power change is initiated by a user activated switch.

26. A system according to claim 22 wherein said steady state magnitude measurement is performed as a function of frequency.

27. A system according to claim 26 wherein said function of frequency is measured with a spectrum analyzer.

28. A system according to claim 22 wherein said at least one transmitting transducer and said at least one receiving transducer are contained in an immersible which is placed inside the vessel.

29. A system according to claim 28 wherein said at least one transmitting transducer and said at least one receiving transducer are within said immersible to form a self-contained measuring system.

* * * * *